US007251919B2

(12) United States Patent
Ray

(10) Patent No.: US 7,251,919 B2
(45) Date of Patent: Aug. 7, 2007

(54) LIGHTWEIGHT BUILDING COMPONENT

(76) Inventor: Manuel A. Ray, 1106 Piccioni St., Apt. 2, Condado, San Juan, PR (US) 00907

( * ) Notice: Subject to any disclaimer, the term of this patent is extended or adjusted under 35 U.S.C. 154(b) by 372 days.

(21) Appl. No.: 10/452,484

(22) Filed: Jun. 2, 2003

(65) Prior Publication Data

US 2003/0200720 A1 Oct. 30, 2003

Related U.S. Application Data

(63) Continuation-in-part of application No. 10/075,187, filed on Feb. 14, 2002, now Pat. No. 6,668,512, which is a continuation-in-part of application No. 09/433, 593, filed on Nov. 2, 1999, now abandoned.

(51) Int. Cl.
*E04B 2/08* (2006.01)
*E04C 5/10* (2006.01)
*E04C 3/00* (2006.01)

(52) U.S. Cl. ..... 52/730.5; 52/320; 52/323; 52/340; 52/633; 52/592.4; 52/650.3; 52/730.4; 52/730.2; 52/592.1; 52/732.1; 52/737.6; 52/731.2; 52/731.3; 52/653.2

(58) Field of Classification Search ..... 52/320, 52/323, 340, 633, 730.1, 730.4, 730.5, 732.1, 52/737.6, 731.2, 732.3, 592.1, 592.4, 650.3, 52/731.3, 731.6, 582.1, 653.2, 730.2
See application file for complete search history.

(56) References Cited

U.S. PATENT DOCUMENTS

| | | | |
|---|---|---|---|
| 511,249 | A | 12/1893 | Oudin |
| 1,090,171 | A | 3/1914 | Schisler |
| 1,183,594 | A | 5/1916 | Robinson |
| 1,646,183 | A | 10/1927 | Bevier |
| 2,082,792 | A | 6/1937 | Dean |
| 3,999,354 | A | 12/1976 | Anter et al. |
| 4,557,031 | A | 12/1985 | Winkler |
| 4,742,660 | A | 5/1988 | Vadala |
| 5,216,863 | A | 6/1993 | Nessa et al. |
| 5,397,096 | A | 3/1995 | Nelson |
| 5,398,909 | A | 3/1995 | Sandwith |
| 5,535,565 | A | 7/1996 | Majnaric et al. |
| 5,729,944 | A | 3/1998 | De Zen |
| 5,740,648 | A | 4/1998 | Piccone |
| 5,806,268 | A | 9/1998 | Koller |
| 5,953,880 | A | 9/1999 | De Zen |
| 6,105,314 | A | 8/2000 | Stocksicker |
| 6,195,953 | B1 | 3/2001 | Gitter et al. |
| 6,250,037 | B1 | 6/2001 | Ezumi et al. |
| 6,405,504 | B1 | 6/2002 | Richardson |
| 6,494,011 | B2 | 12/2002 | Ezumi et al. |

*Primary Examiner*—Jeanette Chapman
(74) *Attorney, Agent, or Firm*—Mayback & Hoffman, P.A.; Gregory L. Mayback; Scott D. Smiley

(57) ABSTRACT

A structural member includes side walls, a top wall connecting a top region of the side walls, a bottom wall connecting side wall bottoms and extending beyond the side walls to form wings each having one portion of a connector for connecting members to one another, a span connected to the side walls, and truss configurations each connected to the span and the bottom wall and respectively to one side wall. Side walls, top wall, and span define an upper interior chamber and span, truss configurations, and bottom wall define a lower interior chamber. Each truss configuration has a vertical wall and two intermediate walls. An assembly of members interlock with one another in series by connecting a first portion of the connector with a second portion of another member. These interlocked members form a structure for receiving concrete as a base for a ribbed concrete slab.

44 Claims, 13 Drawing Sheets

LIGHTWEIGHT BUILDING COMPONENT

CROSS-REFERENCE TO RELATED APPLICATION

This application is a continuation-in-part of allowed application Ser. No. 10/075,187 filed on Feb. 14, 2002, now U.S. Pat. No. 6,668,512 which is a continuation-in-part of application Ser. No. 09/433,593 filed on Nov. 2, 1999 now abandoned.

BACKGROUND OF THE INVENTION

1. Field of the Invention

This invention relates to a single very light tubular building element for the construction of reinforced concrete intermediate floors/ceilings and roofs. The single building element provides the formwork for the casting in place of the structural concrete and also provides for a high quality finished ceiling at the same time. It is intended for simple installation without heavy equipment into building parts. A series of members are often intended to form an exposed surface when used as a floor or ceiling.

A series of members are constructed and often disposed to be the primary means of containing and supporting a panel or slab of concrete as it cures. An interconnected series of members, according to the present invention, also form a continuous mortar impervious formwork for a concrete slab, and presents an attractive permanently exposed ceiling surface.

2. Prior Art

There have been many suggestions for use of either or both temporary or permanent form members to construct building parts of concrete. These form members can be temporary in nature because they are removed after concrete cures, or can be contained in concrete as permanent parts. For example:

U.S. Pat. No. 5,953,880 to de Zen teaches a modular building system of extruded hollow thermoplastic structural components of rectilinear cross-section. These members are made of a special thermoplastic mixture said to resist the elements and are characterized by a fire-resistant outer skin. The concrete is poured inside the thermoplastic components that have internal apertures through which the concrete can flow from one member to another member in a group when they are joined as a wall panel, for example. When the members are to be used in construction of a roof, concrete cannot be used, and metal inserts are called for to assist in stiffening.

U.S. Pat. No. 5,729,944 to de Zen discloses the use of thermoplastic structural components as permanent formwork. The forms can be used in a series to construct various structures. Concrete is poured inside the thermoplastic components that have internal apertures through which the concrete can flow from one member to another member when they are joined as a wall panel.

U.S. Pat. No. 5,397,096 to Nelson is illustrative of conventional concrete forming techniques to manufacture a ribbed, reinforced concrete slab. The forming system utilizes concrete displacement pans supported on temporary framework. Nelson discloses the problem of concrete leaking out of joints. The leaking material normally is without aggregate, and is sometimes referred to as mortar. When the concrete slab or slab cures, workers must, remove the hardened mortar with a chisel, or the like, providing an unsatisfactory surface finish. The bottom surface is neither planar nor finished. Nelson suggests the use of additional members to forestall the leakage of mortar.

U.S. Pat. No. 4,557,031 to Winkler and U.S. Pat. No. 5,216,863 to Nessa et al. are illustrative of other expedients to join extruded plastic form members for use in containing concrete inside. The members are normally a part of the cured concrete structure or building component.

U.S. Pat. No. 5,535,565 to Majnaric et al. is illustrative of a containment including a plurality of panels that are interconnected by connector columns and fused together by the passing of electrical current through conductors received within such elements at their points of intersection. Sliding one adjacent panel over another panel interconnects the panels. A gasket is interposed between a pair of panels to create a watertight environment.

U.S. Pat. No. 4,742,660 to Vadala is illustrative of a highly sound insulating clay tile for the construction of floors that has an outer substantially parallelepiped shape with symmetrical, laterally projecting portions that act as shoulders for the support of each tile by prefabricated reinforced concrete floor beams.

While the field of reinforced concrete formwork is well developed, there is still the need for a relatively inexpensive easy-to-use system to form ribbed-concrete slabs with structural formwork components. The system should not be as labor intensive as prior art configurations. It should use components that are lightweight and yet will control elastic deformation such as is often encountered when steel and aluminum alloy formwork is used to make such ribbed structures. Moreover, each element should be easily aligned with an adjacent member, the alignment measures providing an impermeable alignment between adjacent members. Thus, eliminating the need of additional members (e.g., gaskets) or fusing of the adjacent members to accomplish impermeability.

Further, the members making up the formwork should not be filled with concrete to create the slab. Similarly, the members should include an easy device for placement of reinforcement bars without the need of manual tying or securing of the reinforcement bars together.

It is also desirable to have the ability to incorporate the formwork into the slab and have it serve as an impervious formwork base, eliminating cumbersome cleaning during construction and leakage afterward, and saving the common need of a costly waterproofing membrane over the slab. The formwork should serve for the casting in place of the structural concrete and also should provide for a high quality finished ceiling at the same time, eliminating the need to plaster and otherwise enhance the aesthetic appeal of the ceiling. Finally, the formwork should facilitate hung ceiling installations and also be easily penetrable to hold threaded screws and the like.

SUMMARY OF THE INVENTION

There is provided an elongated tubular member disposed to be interconnected in a series. Each member is constructed of extruded thermoplastic material, is relatively thin walled, and light in weight. In a preferred embodiment, the formwork deck will weigh less than four pounds per square foot, i.e., the individual members weigh about 2 pounds per linear foot. Thus, a 5-meter long member weighs about 32 pounds and can be handled by only one laborer without need of special equipment. The member is intended to be incorporated in structural, reinforced ribbed concrete slabs used in roofs and floors.

The members serve as a continuous mortar impervious formwork on the bottom of a poured concrete slab while it is curing. It, thus, avoids the leakage of concrete mortar through formwork joints during concrete pouring and cure time, which leakage can result in honeycomb void defects that cause the structure to be prone to possible future corrosion of steel reinforcement contained in the concrete slab. Such corrosion is often difficult and costly to repair.

The formwork permanently serves as the bottom of the slab. It is an impervious barrier of the type needed for roof construction and, thus, eliminates the need for an exterior waterproofing membrane. The formwork has transverse, flexural strength and stiffness sufficient to resist vertical and lateral construction loads without significant deformation. It can bear the weight and pressure of wet concrete, needing but few transverse intermediate temporary supports directly under the hollow elements that make up the formwork. For example, a line of 4×4 wooden purlines, spaced about five feet apart over 4×4 wooden shores, also spaced about five feet apart, or equivalent simple systems of metal purlines and shores can be used.

The members are generally formed of a polyvinyl chloride (PVC) alloy conforming to Uniform Building Code (UBC). Any UBC conforming extrudable and lightweight similar material of equal or better strength and durability will be suitable. This general type of thermoplastic is lightweight and easily formed by extrusion with many integral convenient features, but has lower modulus of elasticity (stiffness) than most other construction materials. For example, the modulus of elasticity of steel is more than sixty times than in thermoplastic and the modulus of elasticity for aluminum is more than thirty times than in thermoplastic.

The center section of a member is like the hat crown and the wings of a member are like a hat brim. A member is defined by a top wall and a parallel bottom wall interconnected by parallel side walls that are substantially perpendicular to the top and bottom walls. There is an internal generally horizontal wall between the enclosing side walls. Above that internal horizontal wall and limited by the top and side walls is formed a closed rectangular box-shaped conduit when viewed from an end. In that rectangular space, it is easy to install a band of fiberglass mat to improve thermal insulation of the concrete slab, if desired. Below that internal horizontal wall and connecting it with the bottom and side walls, there can be various internal wall configurations.

For example, in a first configuration of the bottom portion of the member, there is a web of three shorter longitudinal internal walls, one of these internal walls being a longitudinal vertical wall extending from the center of the horizontal internal wall (at a central intersection) to the center of the bottom wall. In one embodiment of the first configuration, the other two web walls are symmetrical and are sloped down and outward from the center intersection. The side wings taper from relatively thick adjacent the side wall to the narrowest area at the end where there is a finger or groove. The sloped walls, side walls, and bottom wall intersecting at the left and right corner areas from where the wings project outward as cantilever, each of them being tapered, the thickest portion being at the end close to the corresponding wing and the narrowest portion being at the other end where intersecting with other walls. These tapered thickness walls (compared to walls with the same amount of material but of uniform thickness) provide smaller deformation of the wings under bending stresses with wet concrete above and much more rotation stiffness at the bottom corners where the wings are attached. As a result of providing these thicknesses, it is possible to control the elastic deformation with limits not detectable visually on ceilings; bottom wall and adjacent wings should be seen in the same plane.

In a second embodiment of the first configuration, the two sloped walls extend symmetrically and are sloped down and outward from a first set of two symmetrical points very close to the center intersection of the horizontal internal wall, through the side walls, and resting at points on the wings near the left and right intersections between the bottom wall and the side walls. Because the sloped walls rest on the wings, they act as tensors and increase the stiffness of each wing sufficient to counter deformation caused by vertical forces acting downward on the top of the wings. In this second embodiment, there is no need to taper the thickness of all members connected at the bottom right and left corner intersections as there is when using the embodiment described above.

In a second preferred configuration, the web of longitudinal walls below the internal horizontal wall is formed by two internal vertical walls located near each of the side walls (i.e., closer to the side walls than to a line defining the midpoint between the side walls), and extended from the internal horizontal wall to the bottom wall. The web of longitudinal internal walls is completed by four short inclined walls, one pair of the inclined walls extending from ends of a central segment of each of the internal vertical walls to the nearby side wall. These inclined walls have reverse slopes, the lower one sloping down to the side wall and the upper one sloping up to the side wall (in other words, the lower one having a negative slope towards the side wall and the upper one having a positive slope towards the side wall). In this second configuration, two narrow vertical truss-like arrangements of internal walls are formed adjacent to the side walls, each engaging a short segment of the bottom wall contiguous to the bottom corner, where a corresponding lateral wing is attached. These configurations make those corners very stiff against the rotation induced thereat when the cantilever wings are loaded from above with the concrete. With the second configuration, there is no need to taper the thickness of all members that meet at the bottom right and left intersection to attain the necessary stiffness there. A second tubular space is created in the element defined by the internal horizontal wall and the bottom wall and limited at sides thereof by the two internal vertical walls. This second tubular space provides various advantages. First, as compared to the first configuration, the second configuration is easier to produce in an extrusion process. The second configuration also requires less material to produce the member and, therefore, decreases the per-unit cost. The most significant advantage, however, is that the second configuration provides the second tubular space—a space useable for many applications. First, the space can receive electrical wiring in a concealed manner. Second, the space can receive devices for ceiling installation of lamps, fans, and similar fixtures. Third, the rectangular space also can be used to easily install therein strips of flexible fiberglass batt insulation. With such insulation, the thermal insulation rating of the structural slab built is significantly increased. A comparison of thermal ratings are set forth in Table 1.

TABLE 1

| Type of Concrete Construction | R (approx.) |
|---|---|
| Conventional Concrete Slab 6" Thick | 0.6 |
| Ribbed Concrete Slab 3.5" Avg. Thickness Over Permanent Form Deck of Elements of the Present Invention | 1.3 (see FIG. 12) |
| Ribbed Concrete Slab as above with Fiberglass Insulation Filling Upper Tubular Space of Elements | 5.0 |
| Ribbed Concrete Slab as above with Fiberglass Insulation Filling Upper and Lower Tubular Spaces of Elements | 8.0 |

There are wing-like webs extending outwardly from each side of each element, the webs having a lower surface that is substantially on the same plane with the outside lower surface of the bottom wall. The outermost end of one wing has an upwardly extending finger or tongue; and the outermost end of the second wing has a groove like an inverted U, disposed upwardly with the opening facing down. The finger and groove serve as an alignment device. The groove-ending wing fits easily above the tongue-ending wing in a lapping relationship between adjacent members when such members are laid up in a series and, thus, are prepared to receive wet concrete. Because each member has both wing ending types, for proper lap matching, all members for a formwork deck are laid with the tongue wing ending on the same side, that side corresponding with the direction in which the installation proceeds.

The construction technique of the present invention facilitates hung ceiling installations to form a plenum through which heating and air conditioning pipes or ducts are passed.

Further, the construction facilitates the accurate alignment of steel reinforcing bars because of the unique construction of parts. The present invention permits the construction of ribbed reinforced concrete slabs with about one-half the weight of concrete, which might otherwise be required, which slabs are both designed for same strength and stiffness.

In some of the applications, it may be convenient or necessary to use the element of the present invention above spans without intermediate temporary supports or with a spacing at distances greater than usual in most building structures. Example of such applications include instances: when construction time saving not only should be procured, but must be maximized; when due to excessive or variable height of the intermediate supports, scaffolds are difficult and costly; when soft soil would be supporting the scaffolds; or many other extraordinary but common conditions. In such situations, extruded elements according to the present invention may be fabricated with about same weight of PVC alloy and having the same overall dimensions as described below.

Any of the three embodiments described above can be fabricated with the top horizontal wall being somewhat lower than the uppermost portion of the side walls, thus forming a small U-shaped recipient chamber to be filled later with a fluid mix that sets with a modulus of elasticity several times that of the PVC alloy of the element, cement mortar, for example. In such a case, the top wall may have extensions like fingers pointing upwards that, together with the ends of the side walls, will hold the layer of material poured on the top tied to the PVC alloy contact surface, to both perform in bending as one integral structural composite. To better accomplish this purpose, the side walls and those upward projections have dovetail-shaped ends. The projections from the top wall can be shorter than the side wall ends to perform as resting means for steel reinforcement that may be needed inside the poured top layer. That reinforcement may be the same common flat type wire reinforcement used between the courses of masonry walls. These modified top configurations easily and economically form what may be considered a general fourth embodiment having longitudinally over 2.5 times the bending stiffness and over 1.7 times the bending strength of the corresponding unmodified embodiment.

The present invention provides various features. For example, the invention provides lightweight, thermoplastic structural formwork members constructed and arranged to be interconnected in a series to serve as formwork for ribbed concrete slabs. Also, the invention provides inexpensive and easy to install structural members for use in constructing ribbed concrete slabs. Further, formwork for ribbed concrete slabs that forms a continuous impervious structure is provided, thus eliminating the needs for exterior waterproofing membranes when used in roof construction. Moreover, the invention provides formwork having a longitudinal and transverse flexural strength and stiffness sufficient to resist the weight of the wet concrete and the vertical and lateral construction loads, yet needing few transverse intermediate temporary supports while the concrete cures. The invention further provides a ribbed concrete formwork having a pleasant appearing exposed surface capable of being used as a finished ceiling with a smooth finish or with embossing that can be formed during the extrusion process at little or no extra cost. The invention also facilitates hung ceiling installation in commercial and institutional buildings where it is necessary to have a plenum for heating and air-conditioning pipes and duct work above the ceiling. The formwork provides outward indicia or other markings indicative of areas in which hanging measures for the ducts and pipes may be located with assurance of sufficient holding strength of easily penetrated material, for example, to screw in hangers for the hung ceiling, ducts, and pipes. The present invention also facilitates installation of thermal insulation for the ribbed slab and accurate and easy installation of steel reinforcing bars and/or splice bars in association with the formwork before pouring of the concrete. Also provided is the construction of ribbed reinforced concrete slabs using about one-half the normal weight and volume of concrete as compared to conventional construction and forming techniques.

Other features that are considered as characteristic for the invention are set forth in the appended claims.

Although the invention is illustrated and described herein as embodied in a lightweight building component, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DETAILED DESCRIPTION OF THE INVENTION

Figure 1:
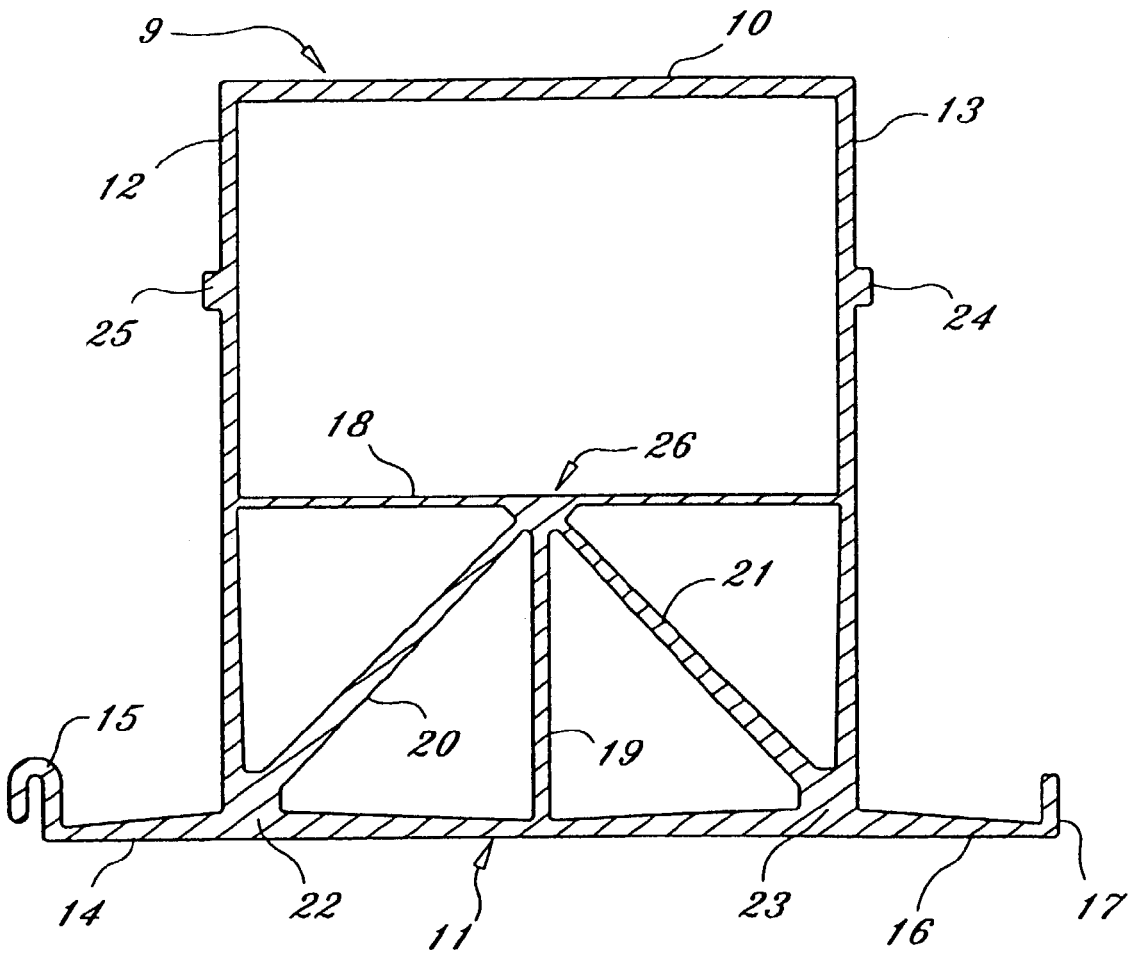
FIG. 1 is a cross-sectional view of a first embodiment of a structural member according to the invention.

Referring now to the figures of the drawings in detail and first, particularly to FIG. 1 thereof, there is shown a tubular structural member 9 according to the invention. It can be generally described as shaped like a top hat in cross-section with an upright central crown and a flat brim about its bottom. The member 9 has a bottom wall 11 and a top wall 10 interconnected by a pair of substantially parallel side walls 12 and 13. Protuberances 24 and 25 provide a mechanical anchorage to the tubular member after the concrete cures, to prevent any separation of the member from the concrete in the event that loads are hung at the bottom of the side walls (e.g., to avoid sliding of the member).

There is a horizontal wall 18 substantially centrally of the member 9, parallel to the top wall 10 and bottom wall or floor 11. There is a vertical wall 19 interconnected between the bottom wall 11 and the horizontal wall 18 at a central intersection 26. There are sloped walls 20 and 21 which extend downwardly and outwardly at the same angle to the left and right of the central intersection of the horizontal wall 18 and the vertical wall 19, with respective opposite ends thereof intersecting the corners formed by the intersection of bottom 11 and side walls 12 or 13, respectively. Areas 22 and 23 are referred to as the bottom left and right intersections.

There is a wing extending outwardly from each side of the member 9, forming the brim of the top-hat cross-section. The right-hand wing 16 terminates in an upwardly extending finger or tongue 17. The left-hand wing 14 terminates in a receiving member 15 having an opening to receive the finger 17. In a series of members 9, as shown, for example, in FIG. 8, the finger 17 or 17' is encompassed within a receiving member 15 having an opening or groove to fit the finger 17. Finger 17 and the receiving member 15 act as an alignment device or means that serves only to align a series of adjacent members according to the present invention. The alignment device does not transmit between the adjacent members any structural load. Rather, each one of the matching wings is able to support independently the load directly above each wing.

The walls (sloped walls, side walls, bottom walls) and wings connecting at the bottom left and right intersections are tapered in thickness, thereby providing bending stiffness against rotation of these corners. The tapering of the wings increases the stiffness of the wings, which serves to absorb bending stress and reduce consequent deformation caused by the vertical construction loads and of the wet concrete forces.

Each of the interior walls 20 and 21 tapers from bottom left and right intersections 22 or 23, respectively, to the central intersection 26. The drawings are not substantially to scale and, in the illustrated preferred embodiment, the taper of walls 22 and 23 is from about four millimeters at the area 22 or 23 to about two millimeters at the area adjacent to 26. The vertical wall 19 is about two millimeters thick in the preferred embodiment. The horizontal wall 18 is about 1.5 millimeters. The top wall 10 is about 3.2 millimeters.

The bottom wall 11, likewise, tapers from the center where it is about two millimeters to a thickness of about four millimeters just before the bottom left and right intersections 22 or 23. The wings 14 and 16 taper from about four millimeters adjacent to a wall 12 or 13 to about 2.5 millimeters just before the alignment device 15 or 17. In this embodiment, the receiving member 15 of the alignment device is about 2.5 millimeters in thickness. The receiving member 15 is curved and in the shape of an upside down "U." The outer surface of the curved section of the, receiving member 15 has a diameter of about 7.7 millimeters. The height is about 9.5 millimeters from the bottom surface of the wing 14 to the top of the curve of the receiving member 15. The curved portion ends 2.5 millimeters from the bottom of the wall to allow insertion of a finger 17. Finger 17 is about 2.6 millimeters thick and the opening or groove of the receiving member is about 3.0 millimeters wide.

The side walls 12 and 13 are about 2.5 millimeters thick from the top wall 10 to the area where the horizontal wall 18 extends across the interior of the member 9. From there, the side walls 12 and 13 taper from about 2.5 millimeters to approximately 4.0 millimeters at the bottom left and right intersections 22 and 23, respectively, in order to increase the stiffness of the bottom left and right intersections. The wing 16 is about 37.1 millimeters from a side wall to the outer surface of the upwardly extending finger 17. The finger extends upwardly about 9.3 millimeters. The wing 14 is approximately 32 millimeters from the wall 12 to the outside surface of the receiving member 15.

Figure 2:
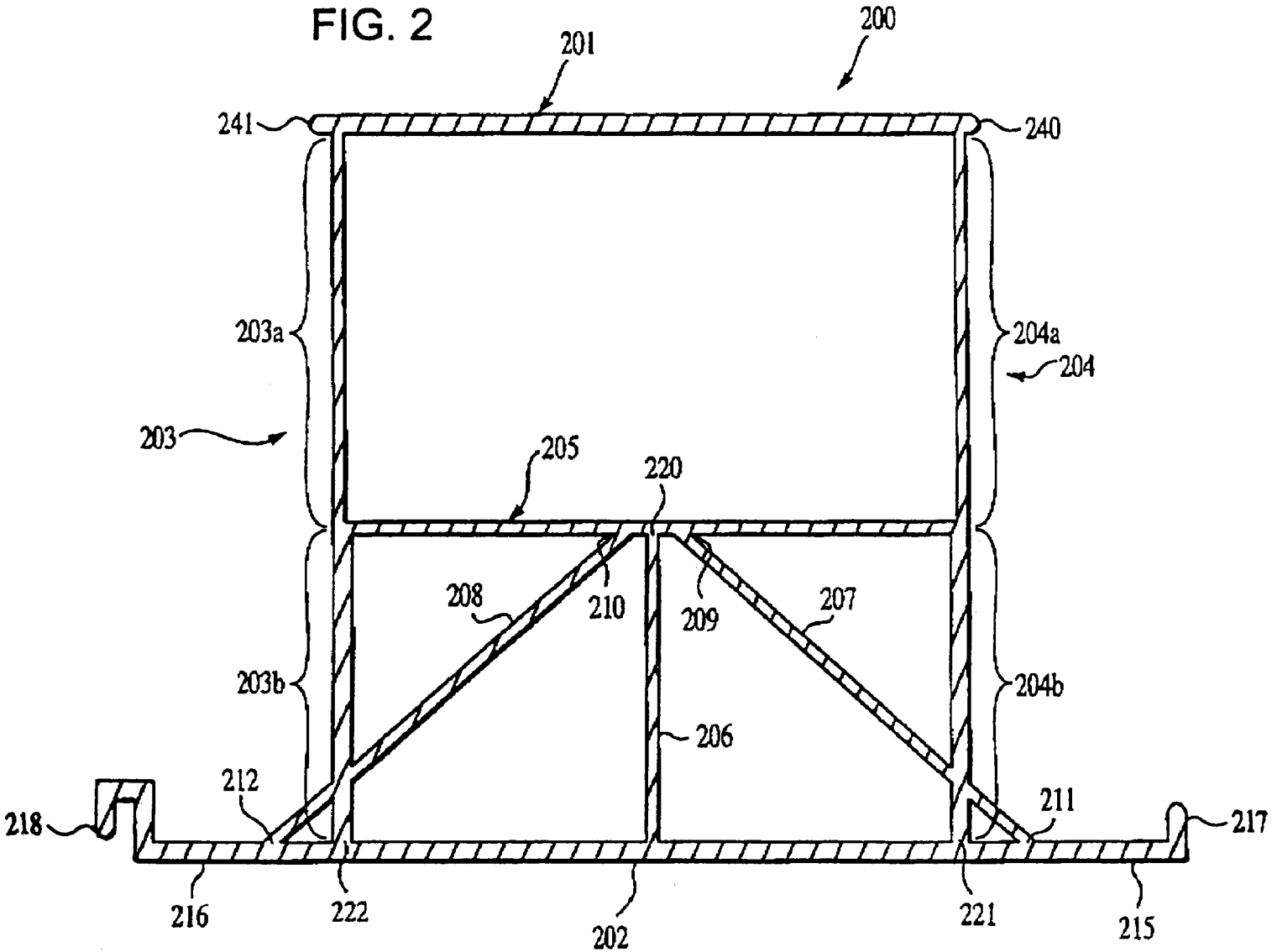
FIG. 2 is a cross-sectional view of a second embodiment of the structural member of FIG. 1.

In FIG. 2, there is shown another embodiment of a tubular structural member according to the invention. The design of this alternative embodiment eliminates the need to taper the walls of any member connected at the bottom right and left intersections 221, 222 (side wall, bottom wall or wing) to control, within acceptable limits, the deformation of the wings caused by the weight of the wet concrete.

FIG. 2 shows an embodiment that has a top side or wall 201, a bottom wall 202, and opposed parallel side walls 203 and 204. There is a horizontal wall 205 centrally located in the member 200, parallel to the top wall 201 and the bottom wall 202. There is a vertical wall 206 interconnected between the bottom wall 202 and the horizontal wall 205 extending from the horizontal wall at a central intersection 220. A first and second sloped wall 207 and 208 extend downwardly and outwardly at the same angle from a first set of right 209 and left 210 points proximate to the central intersection 220. The sloped walls 207, 208 extend through the side walls 203, 204, with opposite ends thereof joined at the wings 215, 216 at a second set of right and left points 211, 212 proximate to the bottom right and left intersections 221, 222 formed by the bottom wall and side walls. In other words, the opposite ends of the sloped walls 207, 208 rest on the wings 215, 216 at a point proximate to the intersection 221, 222 of the side walls 203, 204 and bottom wall 202.

In the embodiment of FIG. 2, the tensors 207, 208 intersect the wings at points 211, 212, respectively, which should be proximate to the bottom left and right intersections 221, 222. The tensors cover a portion of the wings between the bottom left and right intersections 221, 222 and points 211, 212 and form a triangle that is void of concrete. The portions of the side walls (below the intersection of the tensors with the side walls) and the portion of the wings between 211, 212 and 221, 222 respectively, are kept small to make these portions very rigid. As a result, the points from which the wings cantilever is from points 211, 212 to the free ends of the wings. The result is that the bending moment at the attached end of the cantilever (points 211, 212) and the deflection at the tip of the free end of the wings is greatly reduced. Therefore, there is no need to taper any wall or wing as there is in the first embodiment of FIG. 1.

To further increase rigidity of the section of the member below the horizontal wall, the side walls from the right and left intersections 221, 222 to the horizontal wall 205 may be thicker (203*b* and 204*b*), about 3.2 millimeters thick, than the side walls that extend from the horizontal wall 205 to the top walls 201 (203*a* and 204*a*), which are about 2.5 millimeters thick.

Compared to FIG. 1, the top wall 201 is longer and extends slightly beyond the side walls 203, 204 to form small protuberances 240, 241 that provide a mechanical anchorage to the tubular member after the concrete cures and prevent any separation of the member from the concrete in the event that loads are hung at the bottom of the side walls. Protuberances 240 and 241 are approximately 4 millimeters thick and project outward about 3 millimeters.

The sloped walls 207, 208 are thinner, about 1.5 millimeters in thickness because they are not intended to provide any bending stiffness; rather, they act as tensors. The internal horizontal wall 205 and vertical wall 206 are each about 2.0 millimeters thick and the top wall 201 is about 3.2 millimeters thick. The bottom wall or floor 202 is about 3.0 millimeters thick. The wings 215, 216 are about 3.0 millimeters thick. Overall, the thickness of each wall and wing has a preferred thickness of 3.2 millimeters.

Points 211, 212 are about 8.0 millimeters from the bottom left and right intersections 221, 222 of side walls 203, 204 with bottom wall 202. The distance from the bottom and right intersections 221, 222 to the finger 217 is about 33.6 millimeters. The distance from point 211 to the finger 217 is about 25.6 millimeters. The distance from the bottom left intersection 222 to the receiving member 218 is about 36.2 millimeters. The distance from point 212 to the receiving member 218 is about 20.5 millimeters.

Figure 3:
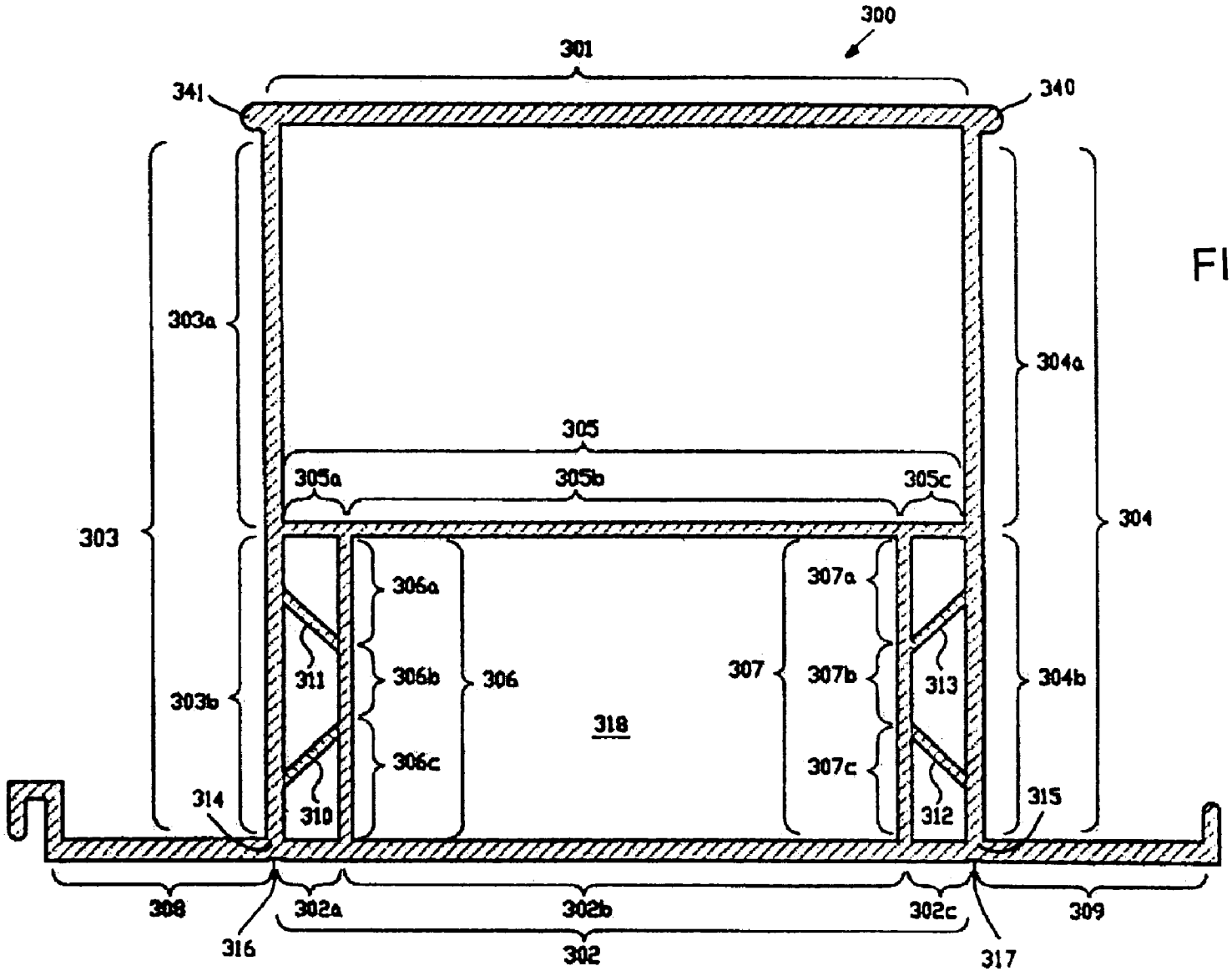
FIG. 3 is a cross-sectional view of a third preferred embodiment of the structural member of FIG. 1.

FIG. 3 illustrates a preferred third embodiment of a tubular structural member according to the invention. The design of this third embodiment eliminates the need to taper any wall, especially, the walls of any member connected at the bottom right and left intersections 22, 23, 221, 222 to control, within acceptable limits, the deformation of the wings caused by the weight of the wet concrete.

The embodiment of FIG. 3 has a top side or wall 301, a bottom wall 302, and opposed parallel side walls 303 and 304. There is a horizontal wall 305 centrally located on the member 300, parallel to the top wall 301 and to the bottom wall 302. There are two vertical walls 306, 307, interconnected between the bottom wall 302 and the horizontal wall 305, extending from the horizontal wall 305 at symmetrical points nearer to the opposing side walls 303, 304 than to a line defining the midpoint between the side walls 303, 304, each of the vertical walls 306, 307 extending from the horizontal wall 305 to the bottom wall 302. The total web of longitudinal internal walls is completed by four inclined walls 310, 311, 312, 313 each shorter than the span of one of the vertical walls 306, 307, each pair of the inclined walls 310, 311 and 312, 313 respectively extending from ends of a central segment 306*b*, 307*b* of each of the vertical walls 306, 307 to the nearby side wall 303, 304. The inclined walls 310, 311, 312, 313 of each pair have reverse slopes with respect to one another. Specifically, the each lower inclined wall 310, 312 slopes down to the respective side wall 303, 304 and each upper inclined wall 311, 313 slopes up to the respective side wall 303, 304. Therefore, the third embodiment of the member 300 according to the present invention provides two narrow vertical trusses 306, 310, 311; 307, 312, 313 adjacent to each of the side walls 303, 304. Each of the trusses engages a respective short segment 302*a*, 302*c* of the bottom wall 302 contiguous to a bottom corner 314, 315 where a corresponding lateral wing 308, 309 is attached.

The top wall 301 is longer than the embodiment of FIG. 1 and similar to the embodiment of FIG. 2 in that extends slightly beyond the side walls 303, 304 to form small protuberances 340, 341 that provide a mechanical anchorage to the tubular member 300 after the concrete cures and prevent any separation of the member 300 from the concrete in the event that loads are hung at the bottom of the side walls 303, 304.

The portions of the side walls (between inclined walls 310, 312 and bottom wall 302; between inclined walls 310 and 311; between inclined walls 312 and 313; and between inclined walls 311, 313 and horizontal wall 305) are kept small to make these portions very rigid. As a result, the points from which the wings 308, 309 cantilever is from points 314, 315 to the free ends of the wings. The result is that the bending moment at the attached end of the cantilever (points 314, 315) and the deflection at the tip of the free end of the wings is greatly reduced. Therefore, there is no need to taper any wall or wing as there is in the first embodiments of FIGS. 1 and 2.

These truss configurations make the corners 314, 315 very stiff against the rotation induced thereat when the cantilever wings 308, 309 are loaded from above with concrete, for example. The third embodiment eliminates the need to taper the thickness of any member that meets at the bottom right and left corners 314, 315 to attain the necessary stiffness there.

A significant by-product of the third embodiment is that a second tubular space 318 is created in the member 300 defined by the internal horizontal wall 305 and the bottom wall 302 and limited at sides thereof by the two internal vertical walls 306, 307.

Figure 4:
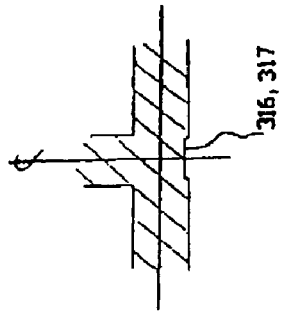
FIG. 4 is a fragmentary, cross-sectional view of an enlarged portion of the structural member of FIGS. 3 and 5.

The bottom wall 302 can have slight depressions 316, 317 so that a threaded screw or other like material can be placed in the middle of the bottom of the side walls 303, 304. An enlarged view of the depressions 316, 317 is shown in FIG. 4. After installation of a slab construction according to the invention, these marked areas 316, 317 will be detectable on the exposed ceiling surface. Threaded screws easily penetrate the plastic material from which the member 300 is made of and are much less expensive and easier to install than power-driven nails and the like, which normally are used with concrete slabs to hang ducts, pipes, etc.

Figure 5:
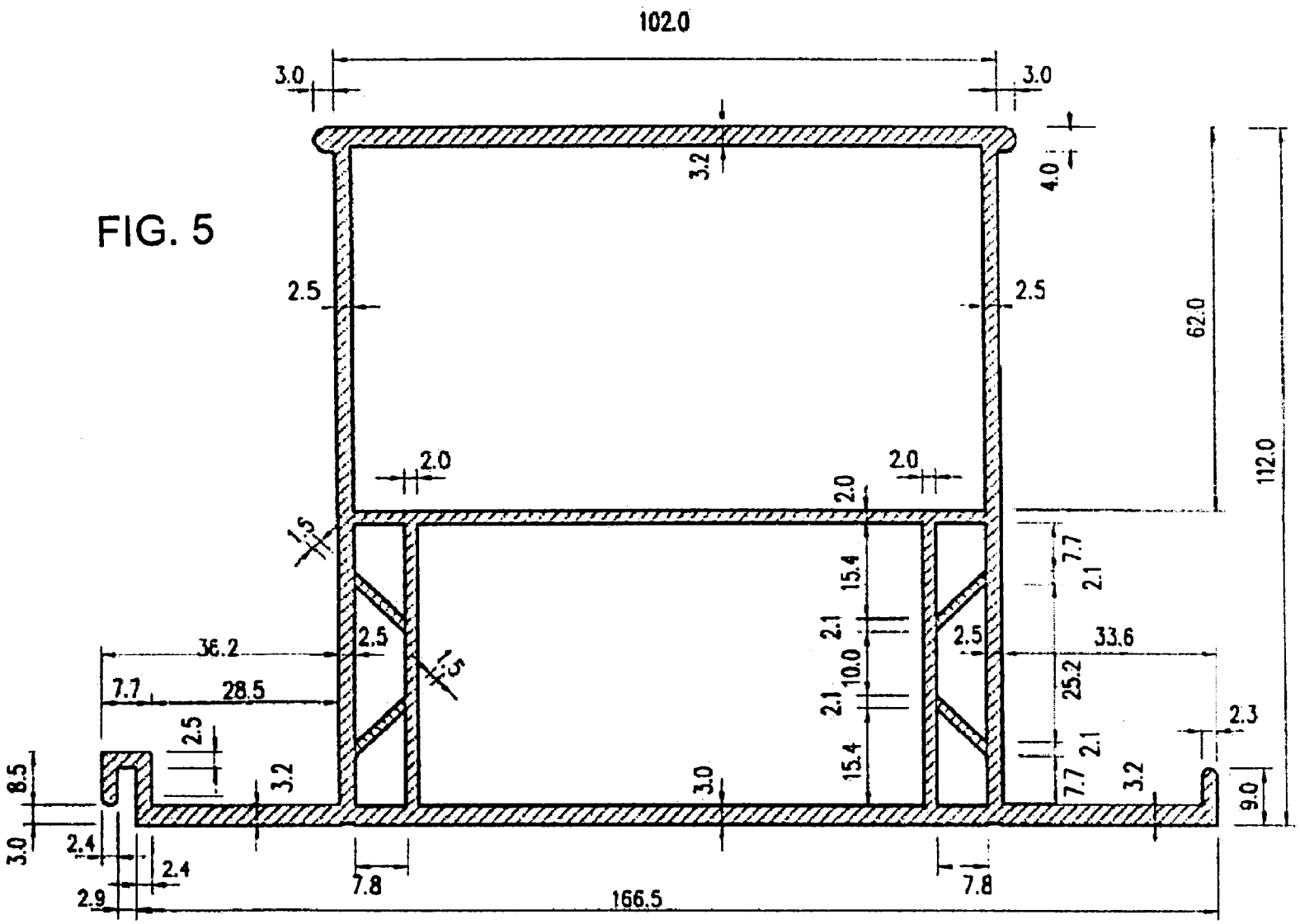
FIG. 5 is a cross-sectional view of a particular embodiment of the structural member of FIG. 3.

FIG. 5 is a preferred configuration for the third embodiment of FIG. 3 and has the dimensions, in millimeters, for each section of the member 300.

Figure 6:
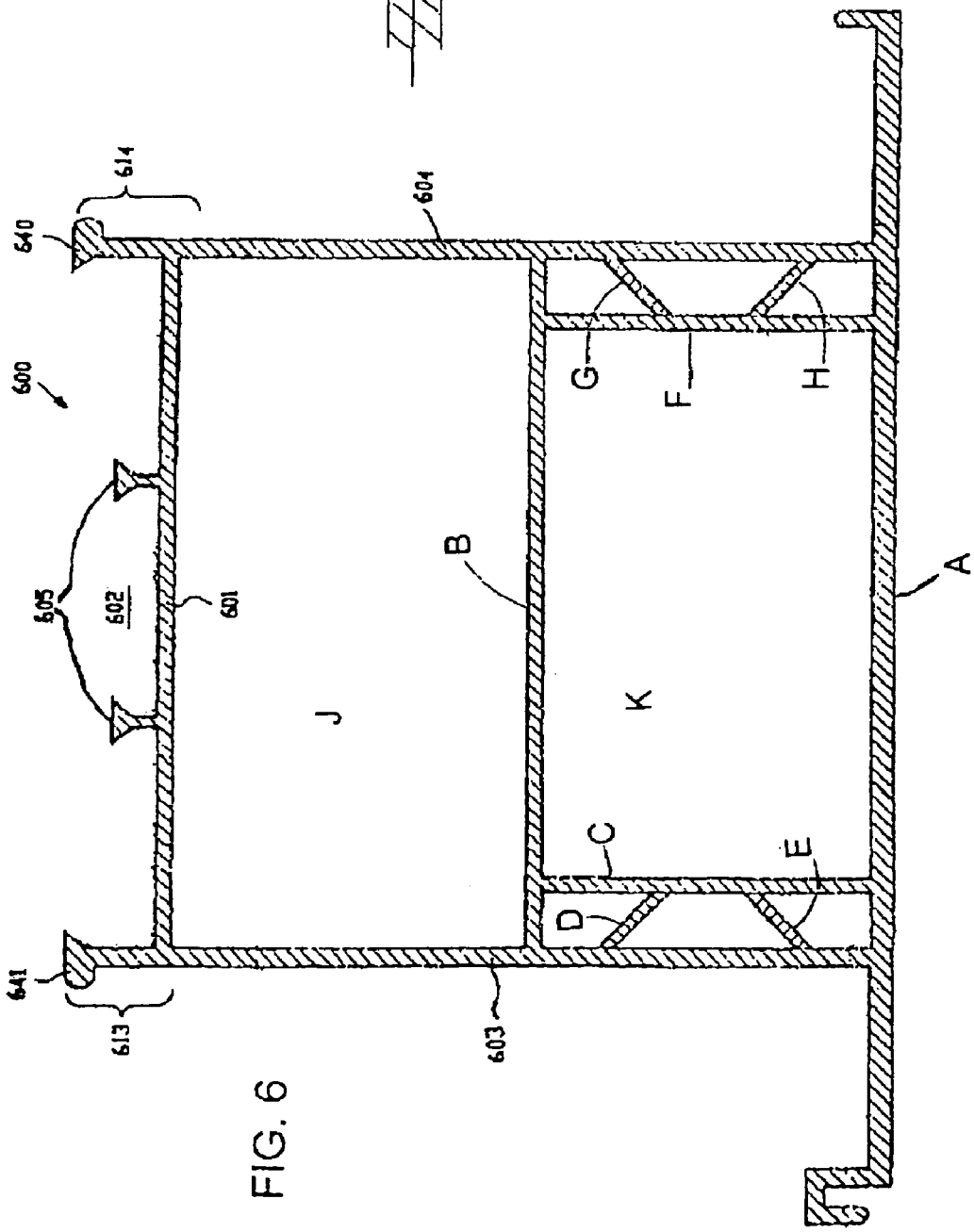
FIG. 6 is cross-sectional view of a fourth preferred embodiment of the structural member of FIG. 1.

FIG. 6 illustrates a preferred fourth embodiment of a tubular structural member 600 according to the invention.

The design of this fourth embodiment is the same as the third embodiment of FIGS. 3 and 5 except that it has a different upper portion. Specifically, the top horizontal wall 601 is lower than the top end of the side walls 603, 604, thereby creating side wall fingers 613, 614 extending up from the top wall 601. Accordingly, a small U-shaped recipient chamber 602 is created that can be filled later with a fluid mix that sets. The addition of the setting fluid (i.e., cement mortar) to the member 600 increases the modulus of elasticity of the member 600 to several times that of the PVC alloy of the member 300. It is noted that the moment of inertia of the embodiment of FIG. 7 with the chamber 602 filled with material 702 and reinforcement 703, 704 is more than 2.5 times greater than the embodiment of FIG. 3.

Figure 7:
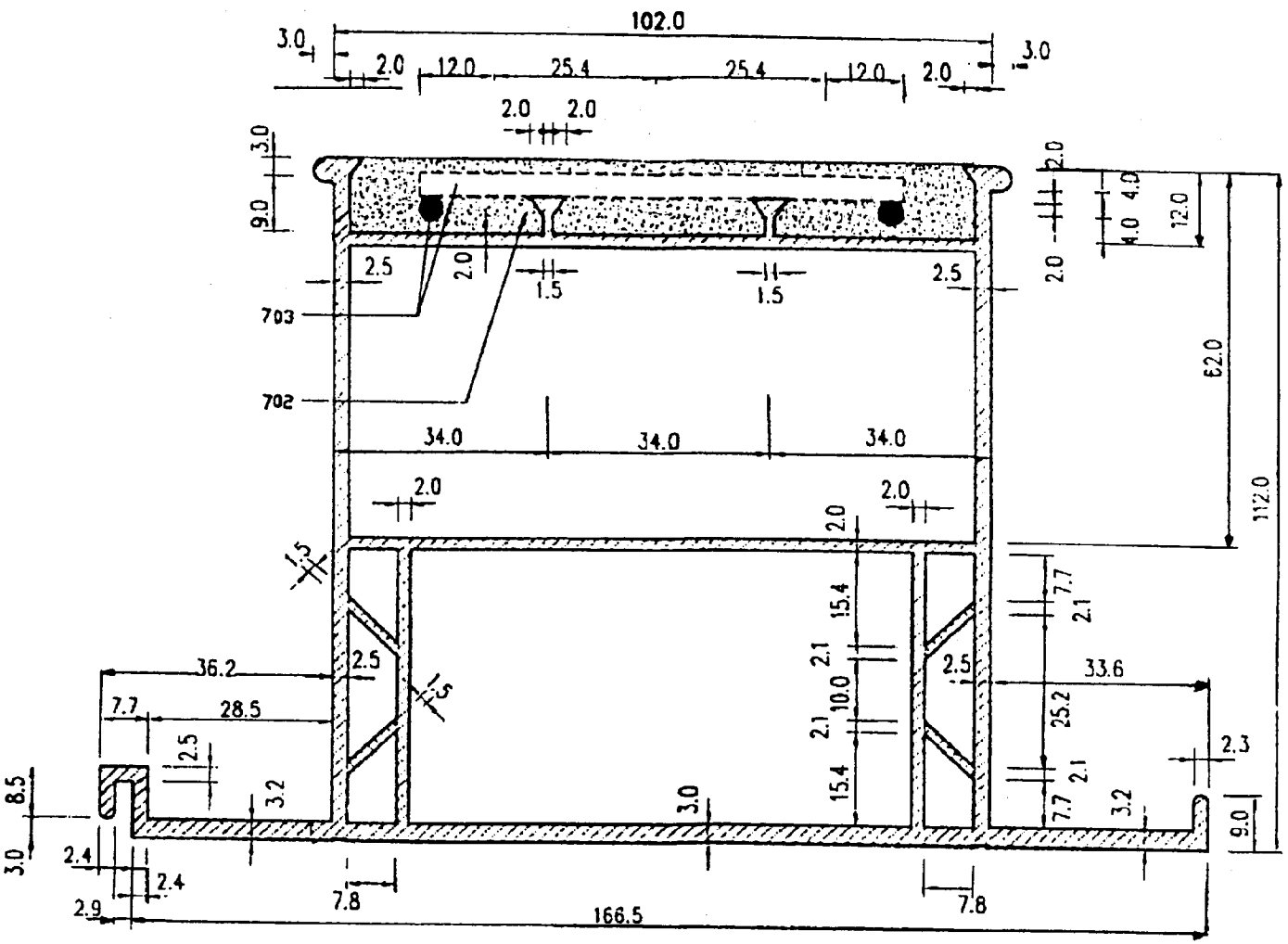
FIG. 7 is a cross-sectional view of a particular embodiment of the structural member of FIG. 6.

FIG. 7 is a preferred configuration for the fourth embodiment of FIG. 6 and has the dimensions, in millimeters, for each section of the member 600. Of course, the embodiment of FIGS. 6 and 7 can be applied equally to the first and second embodiments of FIGS. 1 and 2. FIG. 7 illustrates the chamber 602 filled with material (i.e., cement mortar) 702 and having a wire mesh reinforcement 703.

To increase the ability of the member 600 to hold the mortar 702 filling the recipient chamber 602, the top wall 601 may have fingers 605 extending up from the top wall 601. These fingers 605 hold the mortar 702 together with the upwardly extending side wall fingers 613, 614 forming the side walls of the recipient chamber 602. To better accomplish the holding, the side wall fingers 613, 614 and the upwardly projecting fingers 605 can have dovetail shaped ends. Also, the fingers 605 projecting from the top wall 601 can be shorter than the upwardly extending side wall fingers 613, 614 to provide resting areas for receiving, if desired, steel reinforcement 703 that may be needed inside the poured top layer 702.

In the construction of the embodiments shown in FIGS. 1 to 7, all corners, both inside and outside, are, preferably, rounded to aid in the extrusion process.

Figure 8:
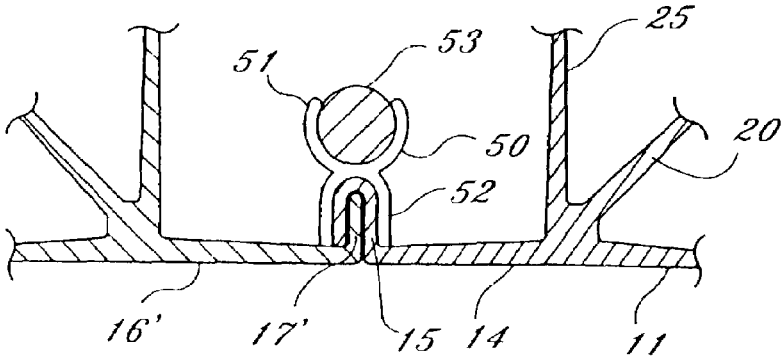
FIG. 8 is a fragmentary, cross-sectional view of a portion of two adjacent structural members of the type shown in FIG. 1 having a reinforcement chair with one reinforcement bar.

In FIG. 8, which is a partial cross-section of some adjacent parts of an adjacent pair of structural members 9, there is shown a wing 14 having a receiving member 15 with an opening that has received therewithin an upwardly extending finger or tongue 17' on a wing 16' of an adjacent member 9 for alignment and water-proofing purposes. The fitting relationship is such that mortar will not flow through the alignment device, thus making the deck impermeable in nature. The alignment device includes a wing 14 that has a receiving member 15 about 0.4 millimeters wider than the thickness of finger 17 to allow easy assembly, and the end of the receiving member 15 rests on top of wing 16' and that contact is made tighter with the weight of the concrete. No fastening device or securing device is necessary to secure the alignment of adjacent members. This configuration is constructed and disposed to provide a simple way to align the members while preventing passage of mortar, thereby creating an impermeable formwork.

Figure 21:
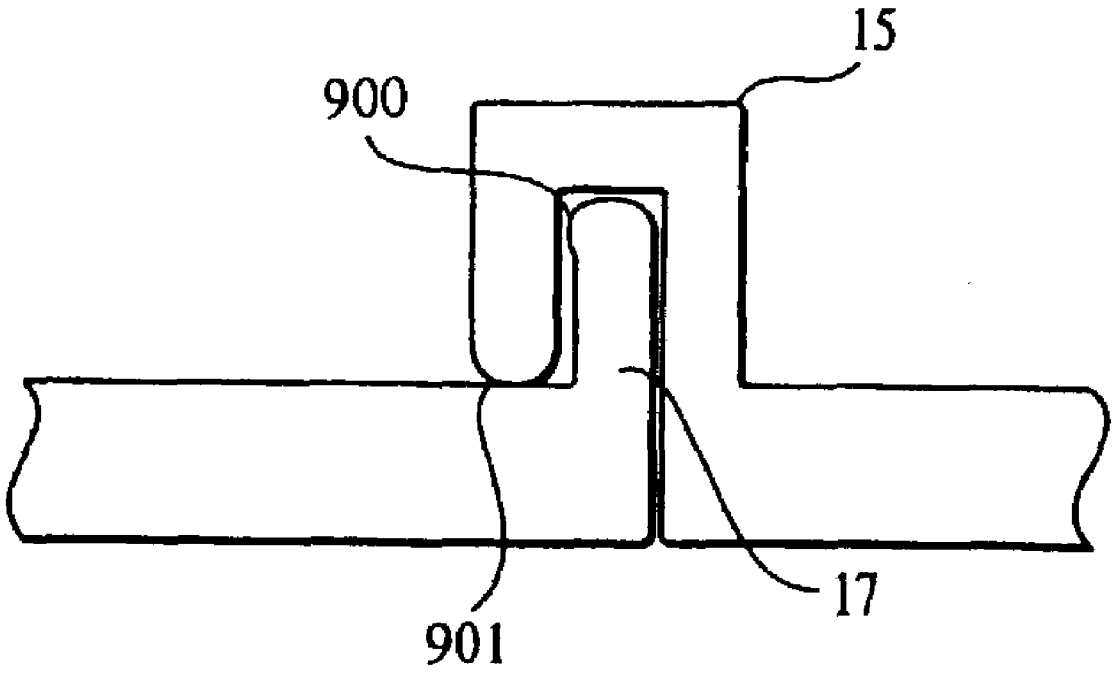
FIG. 21 is a fragmentary, cross-sectional view of an enlarged portion of an alternative embodiment of the longitudinal alignment device of two adjacent structural members according to FIGS. 1, 2, 3, or 4 having a longitudinal lobe.

The wing of a member having a receiving member laps the finger of an adjacent wing. Because the wing having the receiving member is a little longer and laps over the finger, it is subject to a slight increased deflection when receiving wet concrete than that of the wing having the finger. This difference in deflection of the wing having the receiving member causes the receiving member to press down contacting the adjacent wing (see FIG. 21 showing point of contact as 901).

The present invention also includes a reinforcement chair 50 to support reinforcement bars. The chair 50 is removably mountable on the receiving member 15 of the alignment device. FIG. 8 shows a reinforcement chair 50, also made of extruded plastic, having an upward opening 51 to receive a reinforcement bar 53 and a downward opening 52 to mount the receiving member 15 of the alignment device. In such an embodiment, the downward and upward openings 51, 52 are curved in nature to cooperate with the curved alignment device. The downward opening 52 is of sufficient size to engage in a close-fitting but loose relationship with the outer surface of revolution of the opening of the receiving member 15. The downward opening 52 closely conforms to the outer surface of revolution of receiving member 15 and has legs that extend to the top of wings 14 and 16. The upper opening 51 is sized to accept a reinforcing bar 53 in a close-fitting snap-on relationship. The legs are long enough to prevent the reinforcement chair 50 from falling to either side.

Figure 9:
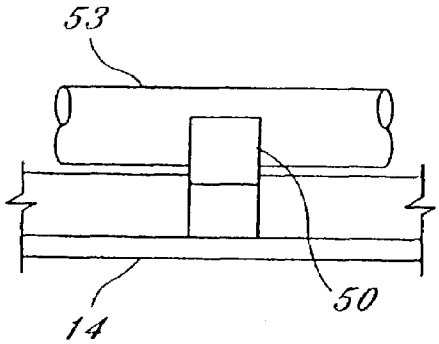
FIG. 9 is a fragmentary, side view of a portion of the reinforcement chair configuration of FIG. 8.

In FIG. 9 there is shown a side elevation of a portion of the parts of FIG. 8, indicating the relationship of the reinforcing bar 53, the reinforcement chair 50, and the plane in which the upper surface of the wing 14 exists. The chairs are spaced about four feet apart. The chairs 50 are about one-half to three-quarter inches long, measuring along the axis of a reinforcing bar or "rebar" as they are sometimes called.

Figure 10:
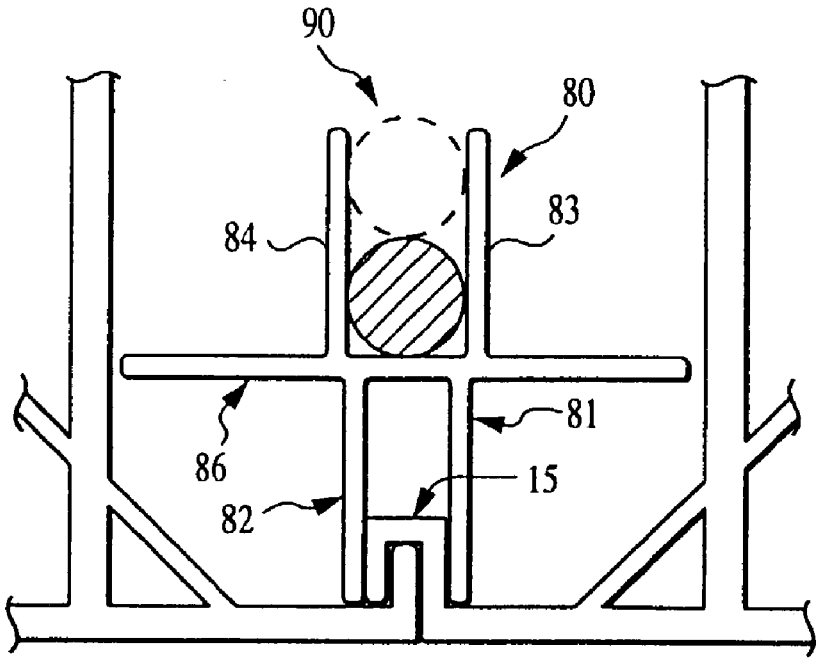
FIG. 10 is a fragmentary, cross-sectional view of a portion of two adjacent structural members of the type shown in FIG. 2 having an alternative embodiment of the reinforcement chair of FIG. 8 with a plurality of reinforcement bars or, alternatively, a reinforcement bar and a splice bar.

In FIG. 10 there is a shown a second embodiment of the reinforcement chair of the invention. The shape of the reinforcement chair 80 is rectangular in nature and could, for example, serve to cooperate with the alignment device shown in FIG. 2. No embodiment is limited to cooperate with a particular reinforcement chair and thus, may be interchangeable as long as the alignment device are of the same shape for cooperation with the reinforcement chair.

FIG. 10 shows a reinforcement chair 80 that is elevated with legs 81, 82 above the receiving member 15 of the alignment device. The chair 80 includes a downward opening formed by the two bottom legs 81, 82 and an upward opening formed by two upper legs 83, 84 to receive a plurality of reinforcement bars 90 (or a reinforcement bar and a splice bar). A horizontal bar 86 extends almost the length between the side walls of two adjacent members and serves to divide the upper legs 83, 84 from the bottom legs 81, 82, and also to support the plurality of reinforcement bars 90. Because of the elevated nature of the reinforcement chair 80, it is necessary to have a horizontal bar 86 that nearly extends the length between two sidewalls of two members to prevent the chair from falling to one side once the wet concrete is poured. Moreover, this embodiment serves to comply with fire codes and other regulations normally imposed in school buildings and other such buildings.

The upper legs 83, 84, lower legs 81, 82, and horizontal bar 86 are about 2.0 millimeters thick. The distance between the adjacent members in FIG. 10 is about 64.7 millimeters. The opening between the two upper legs is about 13 millimeters wide and the opening between the two lower legs is about 8 millimeters wide. The length of the chair is about 15 millimeters.

Figure 11:
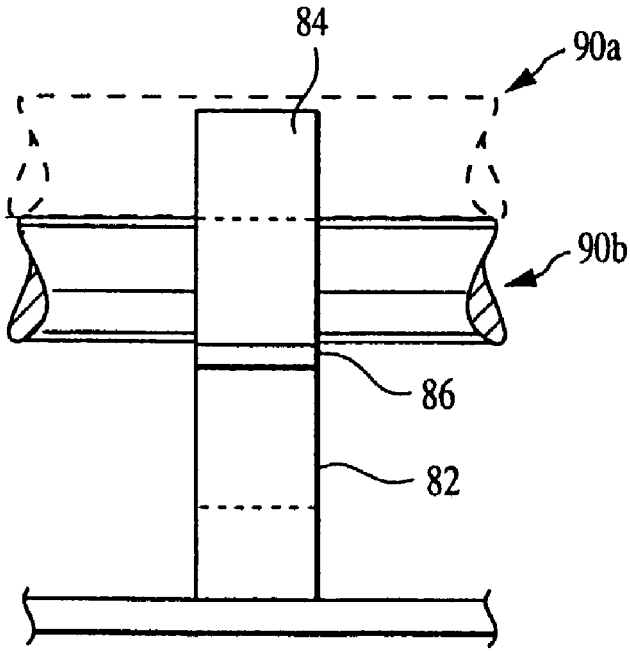
FIG. 11 is a fragmentary, side view of a portion of the reinforcement chair configuration of FIG. 10.

FIG. 11 shows a side view of the reinforcement chair shown in FIG. 10. The reinforcement bar 90*a* is directly on top of another reinforcement bar 90*b* due to the upper legs 83, 84. Ordinarily, reinforcement bars are placed right next to each other in the same horizontal plane and tied together manually for purposes of keeping such bars together in place. This embodiment avoids any manual securing of the reinforcement bars. A laborer need only drop in place the reinforcement bars or reinforcement bar and splice bar in the chair.

Figure 12:
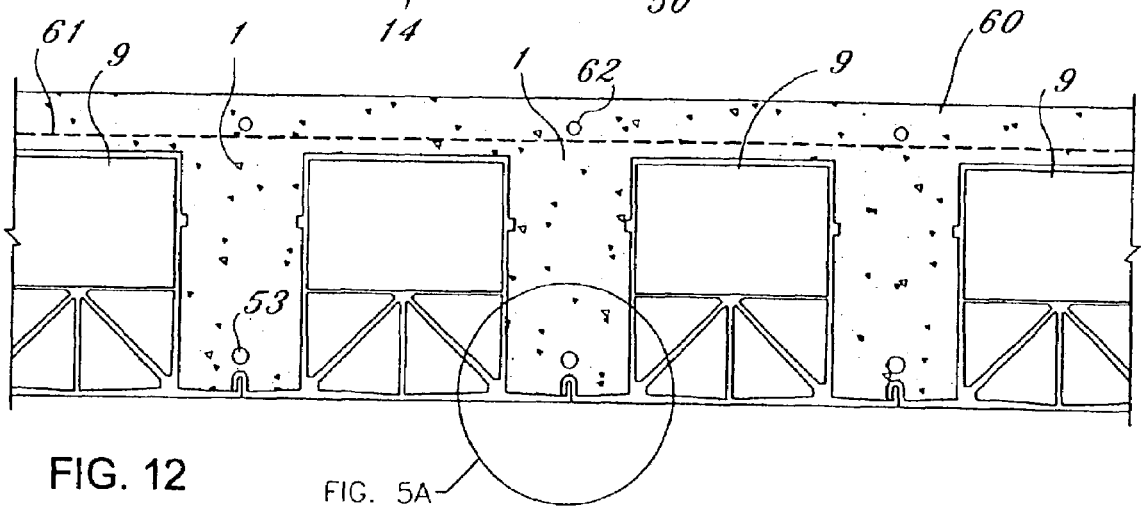
FIG. 12 is a cross-sectional view of a series of the structural members of FIG. 1 in a ribbed concrete slab.

In FIG. 12 there is shown a plurality of the members 9 in a ribbed concrete slab 60. There is shown a wire mesh reinforcement sheet 61 laid on the top surface of the series of the plastic members 9. A series of parallel reinforcing bars 62 are tied to the sheet 61 disposed parallel to the reinforcing bars 53, which reinforcing bars 53 are supported by a series of non-illustrated reinforcement chairs 50. As can be seen, there is formed a series of hollow enclosed valleys. At the bottom of each valley, the mating alignment of adjacent members 9 is engaged in mortar impervious contiguous relation.

Figure 13:
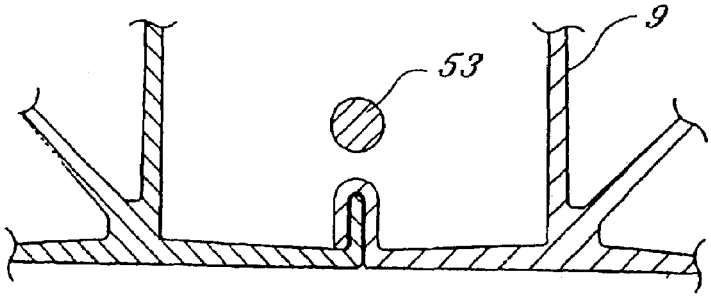
FIG. 13 is a fragmentary, cross-sectional view of a detail of FIG. 12 showing a reinforcing bar in the concrete slab above a longitudinal alignment device of an adjacent pair of the structural members of FIG. 1.

Looking for the moment at the enlarged portion of FIG. 13, which is a detail of a portion of FIG. 12, parts are enlarged to better show the relationship of reinforcing bar 53 in the concrete slab 60.

Figure 14:
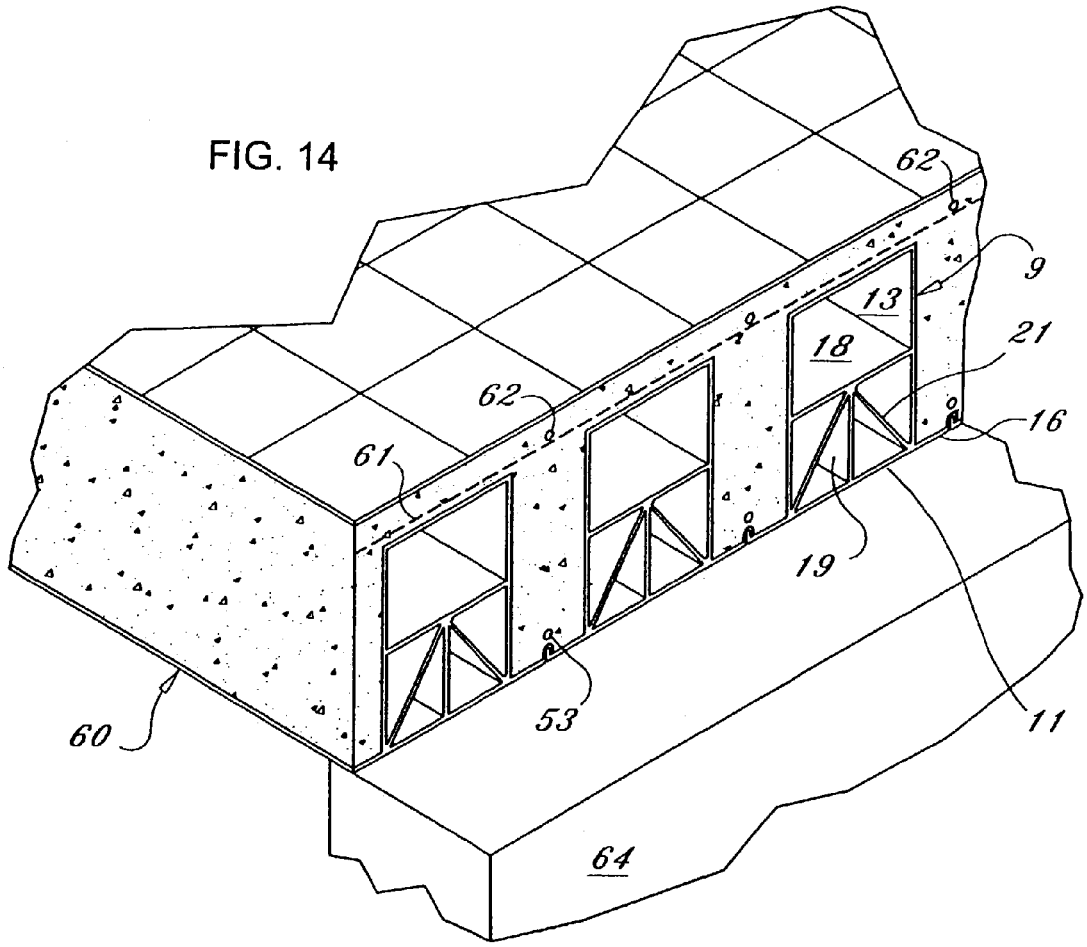
FIG. 14 is a fragmentary, perspective view of the ribbed concrete slab of FIG. 12 on a supporting wall.

FIG. 14 shows a perspective view of a portion of the slab construction of FIG. 12 in which the hollow tubular nature of the member 9 can be better appreciated. This view emphasizes the lightweight nature of a ribbed slab using a series of hollow thermoplastic members according to the invention.

Figure 15:
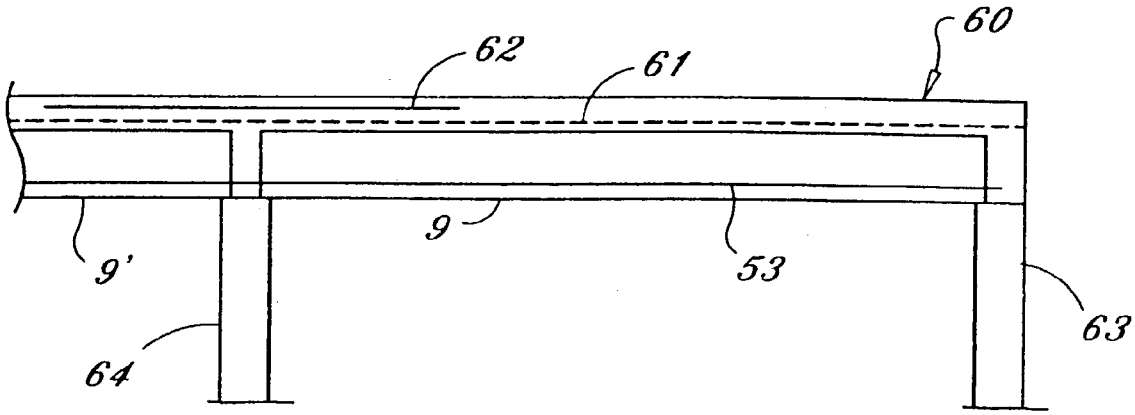
FIG. 15 is a cross-sectional view of a diagrammatic illustration of a configuration of concrete slabs of the type shown in FIG. 14 supported on vertical walls.

FIG. 15 illustrates a ribbed concrete slab as it might be supported in a building. Element 63 is an outside wall and element 64 is an intermediate wall or beam support. Thermoplastic members 9 and 9' are shown in an appropriate fashion supported by the walls 63 and 64. Top rebar 62 is placed exactly above the intermediate supports as shown in FIG. 15. The exposed nature of the ceiling is, likewise, schematically demonstrated. FIG. 15 illustrates concrete poured about the ends of the slabs on top of the walls. There are simple measures, like tape, provided to prevent uncured concrete from entering the plastic members 9 and 9'. The top rebar 62 serves to resist the reverse bending force that occurs above the intermediate support and also to avoid cracking through the joint between 9 and 9'. A series of top rebars 62 is similarly positioned across all such interior joints over the length and width of the structure.

As stated above, the wings project outward from the bottom left/right intersections (Tube) in the same plane of the bottom, as if extensions of the bottom wall formed a ceiling. The concrete ribs of the slab are formed between the side walls of the parallel adjacent members and have the wings of those members forming the bottom of each rib and matching their edges to prevent leakage of the mortar from the wet concrete above them. In the first and second embodiment, the match of the wings is at the center of rib bottom form, each wing carrying structurally and independently the wet concrete above it and being in cantilever from the side wall in one embodiment and mostly in cantilever (from the points 211, 212 outward in FIG. 2) in the second embodiment.

Figure 16:
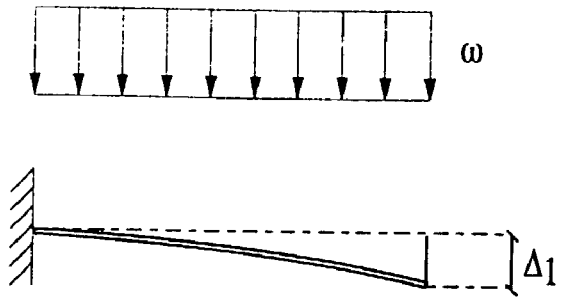
FIG. 16 is a fragmentary, cross-sectional view of a diagrammatic illustration of an elastic deformation of a cantilever when subject to a uniform load with a rigid attachment.
Figure 17:
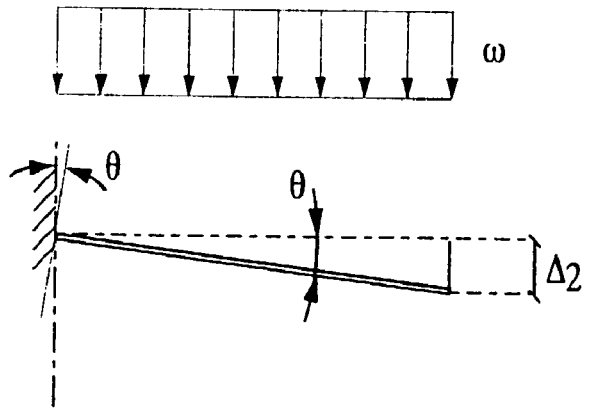
FIG. 17 is a fragmentary, cross-sectional view of a diagrammatic illustration of a rigid cantilever and an elastic deformation of an attaching element when subject to a uniform load.
Figure 18:
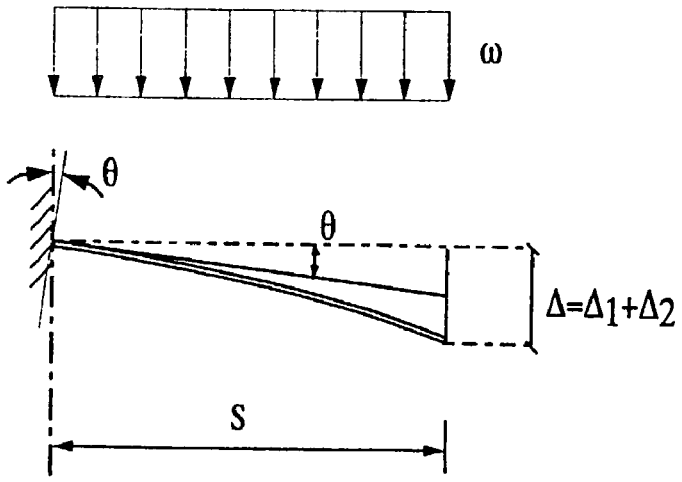
FIG. 18 is a fragmentary, cross-sectional view of a diagrammatic illustration of a maximum deflection at a tip of an elastic deformation of a cantilever attached to an elastic element when subject to a uniform load.

FIGS. 16, 17, and 18 illustrate the elastic deformation of the cantilever and the maximum deflection at the tip when subject to uniform load $\omega$ and when attached to an elastic element.

FIG. 16 shows the deformation assuming the cantilever element is elastic but the attachment (rest of the member) of it is absolutely rigid. The tip deformation will be called $\Delta_1$.

FIG. 17 shows the deformation assuming the cantilever is absolutely rigid but the attaching element (rest of the member) is deformable when subject to the bending moment caused by the cantilever element. The elastic deformation of the attaching element will be a rotation of the attaching plane, represented by the angle $\theta$. The tip of the cantilever will move downward a distance $\Delta_2=\theta\times S$, where S is the width of the wing of the cantilever.

FIG. 18 represents the actual condition, applying the principle of superposition to the above assumptions made for FIGS. 16 and 17. The actual deflection of the tip of the cantilever being $\Delta=\Delta_1+\Delta_2$. The analysis shows the importance and the need to control the rotation of the point of attachment of the wing to reduce $\Delta$ by reducing $\Delta_2$.

As a result, to avoid unpleasant deflection of the wings, there is a need to provide substantial stiffness both to the wings in cantilever and to the tube at the two bottom corners where these wings are attached. In the first embodiment shown in FIG. 1, the stiffness is supplied by providing the bottom left and right intersections formed by the side walls and bottom wall (including sloped walls) with bending stiffness against rotation of these corners. The tapered thickness of these walls, thicker at the bottom left and right intersection and thinner at the other ends, is an effective form to obtain the needed rigidity. In the second embodiment of FIG. 2, a thin tensor extends out to the top of each wing, reducing the cantilever portion of the wing and the forces that cause rotation of the bottom right and left intersections. With these conditions, the uniform thickness is rigid enough and easy to extrude.

It can also be appreciated that the structure of the invention, including the plastic members 9, facilitate hung ceiling installation in commercial and industrial buildings where it is necessary to have plenums to pass heating and air-conditioning ducts and pipes. In the embodiment shown in FIGS. 19 and 20, longitudinal markings 219 at the intersection of the side walls 203, 204 with the bottom wall 202 serve to delineate the boundaries of the side walls 203, 204 so that a threaded screw or other like material can be placed in the middle 223 of the bottom of the side walls 203, 204.

Figure 19:
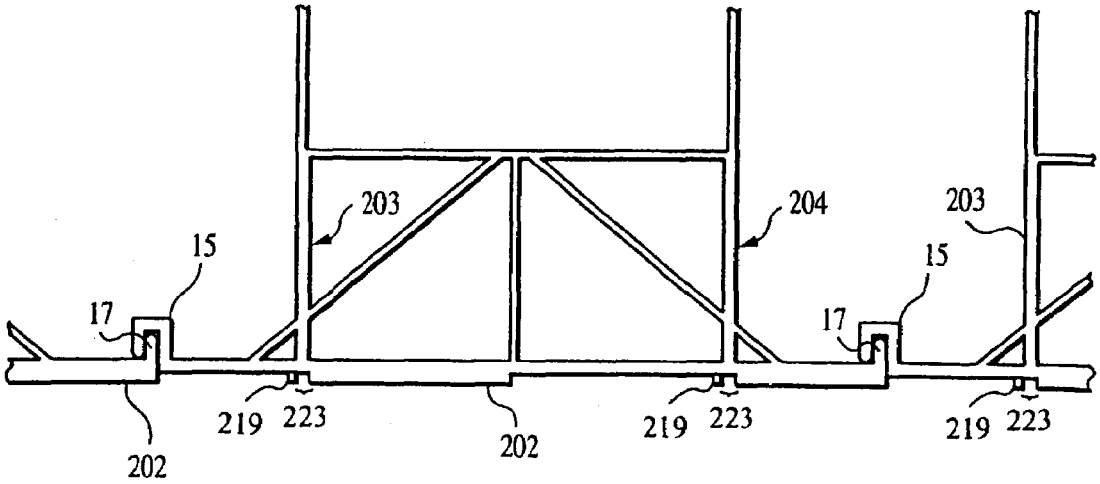
FIG. 19 is a fragmentary, cross-sectional view of a series of structural members of FIG. 2 with exaggerated markings on a ceiling formed by the members.
Figure 20:
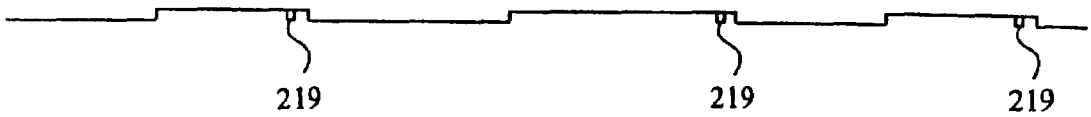
FIG. 20 is a fragmentary, cross-sectional view of a bottom surface of the members of FIG. 19.

As shown in FIG. 20, after installation of a slab construction according to the invention, these marked areas 219 will be detectable on the exposed ceiling surface (the variation in thickness of the wings and bottom walls in FIGS. 19 and 20 are exaggerated for exemplary purposes). Threaded screws easily penetrate the plastic material from which members 9 are made of and are much less expensive and easier to install than power-driven nails and the like, which normally are used with concrete slabs. The variation in thickness between the wings and side walls is about 0.5 millimeters.

The hollow interior of the structural members 9 and 200 facilitate the installation of thermal insulation, for example, by filling the longitudinal tubular portions with fiberglass, either blown or by inserting pieces of insulation mats.

Another embodiment for the alignment device is shown in FIG. 21, which includes an alignment device having a finger with a longitudinal lobe 900. The lobe 900 provides a way of separating that serves to ensure that the finger 17 does not come in direct contact with the left inner side of the receiving member 15 and, thereby, to avoid capillary action to raise water between them. As shown in FIG. 21, the receiving member comes in contact with the wing having the finger at point 901.

Use of the members according to the invention facilitates the accurate and precise placement of steel reinforcing bars, not only because of the novel seat construction, but because it can be accomplished without the cost of the labor involved in tying reinforcing wires, which is the usual practice.

Construction according to the invention provides for reinforced concrete slabs of about one-half the weight and concrete volume. Approximately 80 millimeters or 3.25 inches average thickness of concrete (from top of slab to top of wings buried in concrete) can be used to build a roof slab span of about six meters or 20 feet. In residential intermediate size floor slabs, they can be up to about five meters or 16 feet at the same concrete thickness. Conventionally, the latter would require 180 millimeters or seven inches in normal ribbed reinforced concrete slab.

The time and labor required to build a ribbed concrete slab according to the invention is substantially reduced for many reasons. For example, the task of placing the formwork is much simpler because the present invention is a single component that can be installed easily and efficiently without heavy equipment or special craftsmanship; afterward the component is not removed, but stays permanently integrated in the concrete floor or roof. Additionally, the amount of time to install slab reinforcement is drastically reduced because there is no need to wire the reinforcing bars in place. Additional time and labor are saved because only approximately one-half the volume of concrete is required. No formwork stripping is needed. Ceiling plastering, painting and the like can be eliminated.

In the above description, exemplary dimensions have been given in describing the operation of structural members when incorporated in a ribbed concrete slab forming process. It should be understood by those skilled in the art that other dimensions could be calculated, using conventional techniques, to determine appropriate dimensions for installations other than exemplary ones described herein.

For performance verification, properties of available thermoplastic material have been used. It should be, likewise, understood that plastic materials other than the exemplary one described above, which will provide the properties described to a member made therefrom, are considered the functional equivalent of those described herein and can, thus, also be used.

Having thus described the invention in detail, I claim:

1. A structural device for constructing ribbed concrete slabs, comprising:

an elongate hollow tubular member having:

two side walls;

a top wall connected to said two side walls;

a bottom wall connected to said two side walls, said bottom wall extending beyond said two side walls and forming two external wings;

intermediate walls;

said side walls, said top wall, said bottom wall, and said intermediate walls defining at least two interior chambers, said at least two interior chambers including upper and lower interior chambers;

said intermediate walls forming two truss configurations disposed in one of said two interior chambers, said two truss configurations partially defining said one chamber;

said truss configurations each being disposed in said lower interior chamber at a respective one of said two side walls;

said two side walls being first and second substantially vertically disposed opposing parallel side walls, each of said side walls having an interior side wall surface, a top region and a bottom;

said top wall being a substantially horizontal top wall connecting said top region of said first side wall to said top region of said second side wall and forming a top of said upper interior chamber;

said intermediate walls including a substantially horizontal intermediate span connected to each of said first and second side walls and defining a boundary between said upper and lower interior chambers;

said bottom wall being a substantially horizontal bottom wall connecting said bottom of said first side wall to said bottom of said second side wall; and each of said two truss configurations being connected to said intermediate span and to said bottom wall and being respectively connected to one of said first and second side walls.

2. The device according to claim 1, wherein:

said at least two interior chambers include upper and lower interior chambers; and said truss configurations are each disposed in said lower interior chamber at a respective one of said two side walls.

3. The device according to claim 2 wherein two side walls are first and second substantially vertically disposed opposing parallel side walls.

4. The device according to claim 3, wherein:

each of said side walls have an interior side wall surface, a top region and a bottom;

said top wall is a substantially horizontal top wall connecting said top region of said first side wall to said top region of said second side wall and forming a top of said upper interior chamber;

said intermediate walls include a substantially horizontal intermediate span connected to each of said first and second side walls and defining a boundary between said upper and lower interior chambers;

said bottom wall is a substantially horizontal bottom wall connecting said bottom of said first side wall to said bottom of said second side wall; and each of said two truss configurations are connected to said intermediate span and to said bottom wall and are respectively connected to one of said first and second side walls.

5. The device according to claim 1, wherein said intermediate span is substantially parallel to said top wall and to said bottom wall.

6. The device according to claim 1, wherein said side walls, said top wall, and said intermediate span define said upper interior chamber.

7. The device according to claim 6, wherein said intermediate span, said first and second truss configurations, and said bottom wall define said lower interior chamber.

8. The device according to claim 7, wherein each of said first and second truss configurations are connected to a respective interior side wall surface of said side walls.

9. The device according to claim 8, wherein each of said first and second truss configurations has a vertical wall and two interior truss walls.

10. The device according to claim 9, wherein said vertical wall is connected to said intermediate span and to said bottom wall.

11. The device according to claim 10, wherein each of said two interior truss walls is connected to said vertical wall of one of said first and second truss configurations and to a respective one of said side walls.

12. The device according to claim 11, wherein each of said two interior truss walls slopes at an angle from said vertical wall of one of said first and second truss configurations to said respective one side wall.

13. The device according to claim 12, wherein:

one of said two interior truss walls slopes at a positive angle from said vertical wall of one of said first and second truss configurations to said respective one side wall; and another of said two interior truss walls slopes at a negative angle from said vertical wall of one of said first and second truss configurations to said respective one side wall.

14. The device according to claim 1, further comprising projections integral with said top wall and projecting away from a respective one of said two side walls.

15. The device according to claim 1, wherein each of said first and second wings has one portion of a two-portion connecting device.

16. The device according to claim 15, wherein:

said member is a plurality of members; and one portion of said two-portion connecting device interlocks with another portion of said two-portion connecting device to connect one of said members to another of said members.

17. The device according to claim 16, wherein said members interlock in series with one another to form a structure for receiving concrete as a base for a ribbed concrete slab.

18. The device according to claim 1, wherein:

each of said side walls have a top; and said top wall connects said top of said first side wall to said top of said second side wall.

19. The device according to claim 1, wherein said bottom wall has longitudinal markings.

20. The device according to claim 1, wherein:

said top region has a bottom; and said top wall is connected to said bottom of said top region of said first side wall and to said bottom of said top region of said second side wall to form:

side wall fingers respectively extending along said side walls away from said top wall; and an upper exterior chamber for receiving a material therein.

21. The device according to claim 20, wherein said side wall fingers have dovetail-shaped ends.

22. The device according to claim 20, further comprising fingers attached to said top wall between said two side walls and extending parallel to said side walls away from said top wall.

23. The device according to claim 22, wherein said fingers have dovetail-shaped ends.

24. The device according to claim 1, wherein said member is of PVC alloy.

25. A structural device for constructing ribbed concrete slabs, comprising:

an elongate hollow tubular member having:

two side walls each having a top region with a bottom thereof;

a substantially horizontal top wall connecting said bottom of said top region of said first side wall to said bottom of said top region of said second side wall to form:

side wall fingers respectively extending along said side walls away from said top wall; and an upper exterior chamber for receiving a material therein;

a bottom wall connected to said two side walls, said bottom wall extending beyond said two side walls and forming two external wings;

intermediate walls;

said side walls, said top wall, said bottom wall, and said intermediate walls defining at least two interior chambers;

said intermediate walls forming two truss configurations disposed in one of said two interior chambers, said two truss configurations partially defining said one chamber.

26. The device according to claim 25, further comprising fingers attached to said top wall between said two side walls and extending parallel to said side walls away from said top wall.

27. An assembly for constructing ribbed concrete slabs, comprising:

a plurality of elongate hollow tubular members each having:

two side walls being first and second substantially vertically disposed opposing parallel side walls, each of said side walls having an interior side wall surface, a top region and a bottom;

a top wall connected to said two side walls;

intermediate walls defining at least two interior chambers and forming two truss configurations disposed in one of said two interior chambers, said at least two interior chambers including upper and lower interior chambers, said truss configurations each being disposed in said lower interior chamber at a respective one of said two side walls, said two truss configurations partially defining said lower interior chamber;

said top wall being a substantially horizontal top wall connecting said top region of said first side wall to said top region of said second side wall and forming a top of said upper interior chamber;

said intermediate walls including a substantially horizontal intermediate span connected to each of said first and second side walls and defining a boundary between said upper and lower interior chambers;

a bottom wall extending beyond said two side walls and forming two external wings, one of said wings having a first portion of an interlocking assembly and another of said wings having a second portion of an interlocking assembly, said bottom wall being a substantially horizontal bottom wall connecting said bottom of said first side wall to said bottom of said second side wall; and each of said two truss configurations being connected to said intermediate span and to said bottom wall and being respectively connected to one of said first and second side walls; and said members being adapted to interlock with one another in series by connecting said first portion of one member with said second portion of another member.

28. The assembly according to claim 27, wherein said plurality of said members are interlocked with one another in series form a structure for receiving concrete as a base for a ribbed concrete slab.

29. A structural member, comprising:

first and second substantially vertically disposed opposing parallel side walls each having a top region, and a bottom;

a substantially horizontal top wall connecting said top region of said first side wall to said top region of said second side wall;

a substantially horizontal bottom wall connecting said bottom of said first side wall to said bottom of said second side wall, said bottom wall extending beyond said two side walls and forming two external wings each having one portion of a two-portion connecting device for connecting one structural member to another structural member;

a substantially horizontal intermediate span connected to each of said first and second side walls and disposed parallel to said top wall and to said bottom wall;

said side walls, said top wall, and said intermediate span defining an upper interior chamber;

first and second truss configurations each connected to said intermediate span and to said bottom wall and respectively connected to one of said first and second side walls;

said intermediate span, said first and second truss configurations, and said bottom wall defining a lower interior chamber; and each of said first and second truss configurations having a vertical wall and two intermediate walls.

30. The member according to claim 29, wherein:

each of said side wails have a top; and said top wall connects said top of said first side wall to said top of said second side wall.

31. The member according to claim 29, wherein:

said top region has a bottom; and said top wall is connected to said bottom of said top region of said first side wall and to said bottom of said top region of said second side wall to form:

side wall fingers respectively extending along said side walls away from said top wall; and an upper exterior chamber for receiving a material therein.

32. The member according to claim 29, wherein each of said first and second truss configurations has:

a vertical wall connected to said intermediate span and to said bottom wall; and two interior truss walls each connected to said vertical wall of one of said first and second truss configurations and to a respective one of said side walls.

33. The member according to claim 32, wherein each of said two interior truss walls slopes at an angle from said vertical wall of one of said first and second truss configurations to said respective one side wall.

34. The member according to claim 33, wherein:

one of said two interior truss walls slopes at a positive angle from said vertical wall of one of said first and second truss configurations to said respective one side wall; and another of said two interior truss walls slopes at a negative angle from said vertical wall of one of said first and second truss configurations to said respective one side wall.

35. Tubular lightweight and extruded plastic structural members for use in constructing ribbed concrete roof and mid-level floor/ceiling slabs, comprising:

an elongate tubular member, said member being generally rectilinear in cross-section, having four longitudinal walls defining an interior and comprising a pair of side walls, a floor, and a top;

there being a horizontal wall disposed between said top and said floor substantially parallel to said top and said floor, and extending between said side walls to form upper and lower hollow conduit sections of said interior of said member;

there being two vertical walls substantially parallel to said side walls and extending from said horizontal wall to said floor;

there also being, between each of said two vertical walls and a respective one of said side walls, first and second sloped walls each extending from a respective one of said vertical walls to said respective one of said side walls; and said floor having a bottom surface extending beyond said side walls on each side of said member, but lying in substantially the same plane, and forming a wing on each side of said member, each wing having an outer longitudinal edge with cooperating alignment means disposed to align said member with a next adjacent wing edge of another different member in a moisture resistant relationship when a plurality of said members are interconnected to form a concrete form.

36. The tubular structural member according to claim 35, wherein said top, said side walls, and said horizontal wall define said upper conduit section.

37. The tubular structural member according to claim 35, wherein said horizontal wall said vertical walls and said floor define said lower conduit section.

38. The tubular structural member according to claim 35, wherein said horizontal wall is substantially centrally located between said top and said floor.

39. The tubular structural member according to claim 35, wherein said first and second sloped walls each slope in different directions with respect to horizontal.

40. The tubular structural member according to claim 39, wherein said first and second sloped walls each slope in at approximately the same angle.

41. The tubular structural member according to claim 35, wherein said vertical walls are each disposed closer to a respective one of said side walls than to a midpoint between said side walls.

42. The tubular structural member according to claim 35, wherein said member has longitudinal markings to facilitate hung ceiling installation.

43. The tubular structural member according to claim 35, wherein said alignment means is:

an upwardly extending finger-shaped ridge along one wing edge; and a complimentary receiving member defining an opening fitting said ridge along another wing edge, said ridge and said receiving member engaging in a substantially mortar impervious mating relationship when attached to another corresponding one of said receiving member and said ridge of another of said members.

44. The tubular structural member according to claim 43, wherein said ridge finger has a longitudinal lobe to prevent passage of water caused by capillary action.

* * * * *